United States Patent [19]

Fogarty et al.

[11] Patent Number: 4,464,861

[45] Date of Patent: Aug. 14, 1984

[54] PLUSH TOY

[76] Inventors: A. Edward Fogarty; Bonnie R. Fogarty, both of 3513 School Ave., Sarasota, Fla. 33579

[21] Appl. No.: 484,631

[22] Filed: Apr. 13, 1983

Related U.S. Application Data

[63] Continuation-in-part of Ser. No. 341,851, Jan. 2, 1982, abandoned.

[51] Int. Cl.[3] ..... A63H 33/26

[52] U.S. Cl. ..... 446/370; 446/175; 446/385; 446/485

[58] Field of Search ..... 46/226, 227, 228, 229, 46/151

[56] References Cited

U.S. PATENT DOCUMENTS

| | | | |
|---|---|---|---|
| 1,110,100 | 9/1914 | Ambash | 46/228 |
| 2,470,612 | 5/1949 | Galter | 46/228 X |
| 2,744,189 | 5/1956 | Wudyka | 46/228 X |
| 2,932,917 | 4/1960 | Patane | 46/228 |
| 3,791,068 | 2/1974 | Pietrowiak | 46/228 |
| 3,808,418 | 4/1974 | Conard et al. | 46/228 X |

*Primary Examiner*—Mickey Yu

*Attorney, Agent, or Firm*—Benjamin P. Reese, II

[57] ABSTRACT

An electrically lighted plush toy having a glowing face or head. A semi-rigid vinyl, hollow, translucent head has a plush exterior cover attached thereto. The plush exterior cover encloses a resilient mass which surrounds an essentially cylindrical, molded plastic, translucent battery and lightbulb housing. A retaining ring in the neck portion of the head coaxially positions and retains the housing. The housing has an integrally molded battery compartment, an integrally molded globe for enclosing a lightbulb, and an integrally molded operating lever positioned on its exterior. A first electrical conductor and a second electrical conductor are positioned in the interior of the housing with at least one battery and a lightbulb. The operating lever is adapted for depressing the first electrical conductor through an opening in the housing to contact the second electrical circuit and complete an electrical circuit formed by the electrical conductors, battery and lightbulb to light the lightbulb. When pressure is applied to the front of the exterior cover of the plush toy, the resilient mass depresses the operating lever which in turn depresses the first electrical conductor to light the lightbulb and cause the face or head of the plush toy to glow.

9 Claims, 6 Drawing Figures

PLUSH TOY

BACKGROUND OF THE INVENTION

This is a continuation-in-part of application Ser. No. 341,851, filed Jan. 2, 1982 abandoned.

This invention relates to an electrically lighted plush toy for use by young children at bedtime.

It is well known that many young children find it easier to fall asleep if they cuddle a plush toy or other similar article at bedtime. It is generally believed that such children derive a sense or feeling of security from their mental image of the plush toy as an affectionate friend. Furthermore, physical contact with the soft, luxurious fabric used for manufacture of most plush toys in and of itself gives such children a greater sense or feeling of security at bedtime.

Conventional plush toys which are safe and suitable for use by young children for play and at bedtime are well known in the prior art. The popularity of plush toys, particularly those in the form of baby animals, with young children in the United States is well known. At least a portion of the present popularity of plush toys can be traced to a famous cartoon during the presidency of Theodore Roosevelt depicting the President sparing the life of a bear cub while hunting. Most children born in the United States subsequent to the Roosevelt era have had, or will have, at least one "teddy bear" during their early childhood years.

It would appear from an examination of commercially available plush toys that numerous efforts, many of them successful, have been made to increase the play value of plush toys to young children. For example, plush toys having moveable limbs or other similar operative features are well known. Plush toys having bells, rattles, squeakers or other sound producing means are also well known. And, plush toys having various ornamental designs, such as designs originally created for cartoon, greeting card and story book characters, are well known. Yet other than a possible incidental benefit from the use of friendly character designs, it would appear that most modern plush toys have no greater capability for providing a sense or feeling of security for young children at bedtime than the plush toys of earlier eras.

A plush toy which has substantially increased capability for providing a sense or feeling of security for young children at bedtime is highly desirable. Preferably, such a plush toy would also have substantially increased play value for young children. It is also preferable that such a plush toy be washable in a conventional automatic washing machine and relatively inexpensive to manufacture. And, of course, such a plush toy must be safe and suitable for use by young children for play and at bedtime.

It is well known that many young children find it easier to fall asleep at bedtime if a night light or other soft light is glowing in the bedroom or shining from an adjacent hallway. It is, therefore, believed that an electrically lighted plush toy having a glowing face or head would have substantially increased capability for providing a sense or feeling of security for young children at bedtime. In that regard, the prior art provides electrically lighted dolls, teddy bears and other similar devices having glowing eyes, faces or heads. Unfortunately, none of the prior art devices of this general type which are known to the Applicants are safe and suitable for use by young children for play and at bedtime. Furthermore, none of the prior art devices of this general type which are known to the Applicants are washable in a conventional automatic washing machine.

For example, the battery housing positioned in the interior of the electrically lighted doll which is disclosed in U.S. Pat. No. 2,932,917 has a conductive coating on its exterior surface, metallic spring fingers extending outwardly and upwardly from its base and an unprotected lightbulb extending out of its top. And, since the battery housing is mounted on a plug which is fitted in an opening in the bottom of the doll, a soft, pliable rubber body, it would be relatively easy for a young child to remove the battery housing from the interior of the doll and expose himself or herself to the dangers of the conductive coating, spring fingers and unprotected lightbulb. In U.S. Pat. No. 1,110,100, the electrically lighted teddy bear which is disclosed has a battery positioned in the interior of its body and electric wires interconnecting the battery and a pair of unprotected minature lightbulbs positioned in the interior of its head. The electrically lighted monkey disclosed in U.S. Pat. No. 2,744,189 has an open clip type battery and lightbulb housing positioned in its interior.

If a young child obtains access to the interior of the teddy bear disclosed in U.S. Pat. No. 1,110,100 or the monkey disclosed in U.S. Pat. No. 2,744,189, he or she will be exposed to the dangers of unprotected lightbulbs, batteries and electrical circuits and various small objects which could cause injury to his or her eyes, ears, nose, mouth, throat or other body parts. The doll, teddy bear and monkey disclosed in U.S. Pat. Nos. 2,932,917, 1,110,100 and 2,744,189 respectively are clearly unsafe and unsuitable for use by young children for play and at bedtime. Furthermore, neither of these devices is washable in a conventional automatic washing machine.

SUMMARY OF THE INVENTION

The present invention provides an electrically lighted plush toy having a glowing face or head. In particular, the present invention provides such a plush toy which is safe and suitable for use by young children for play and at bedtime. Additionally, the present invention provides such a plush toy which is washable in a conventional automatic washing machine and relatively inexpensive to manufacture.

The electrically lighted plush toy of the present invention comprises a semi-rigid vinyl, hollow, translucent head having a plush exterior cover fixedly attached. A fabric liner is sewn to the exterior cover and a resilient mass of soft fibrous material is stuffed between the exterior cover and the fabric liner. In its preferred embodiment, the plush exterior cover and the resilient mass respectively have the approximate configuration of the skin and body of a segmented worm.

A molded plastic retaining ring is fixedly attached in the interior of the neck portion of the semi-rigid vinyl, hollow, translucent head. The retaining ring is used to coaxially position and retain an essentially cylindrical, molded plastic, translucent battery and lightbulb housing in the interior space circumscribed by the exterior cover, resilient mass and fabric liner such that the integrally molded battery compartment of the housing is positioned in such space and the intergally molded globe of the housing is positioned in the interior of the head. An opening is provided through the exterior cover, resilient mass and fabric liner for access to the interior space for installation and removal of the battery and lightbulb housing.

For safety reasons, the battery and lightbulb housing is comprised of a right hand housing element which circumscribes one-half of the battery compartment and one-half of the globe and a left hand housing element which circumscribes the other half of the battery compartment and the other half of the globe. Means are provided for assembly and disassembly of the housing in a manner which is relatively easy for adults but extremely difficult for young children. The batteries, lightbulb and all electrical conductors necessary for lighting the plush toy are contained in the assembled battery and lightbulb housing to prevent a young child from exposing himself or herself to the dangers of unprotected lightbulbs, batteries, electrical circuits and small objects even if he or she obtains access to the interior space circumscribed by the exterior cover, resilient mass and fabric liner and successfully removes the battery and lightbulb housing from the retaining ring.

An operating lever which is molded as an integral component of one of the housing elements causes a first electrical conductor in the housing to contact a second electrical conductor in the housing, and, thereby, complete an electrical circuit to light the lightbulb positioned in the globe when a child applies pressure on the front of the exterior cover of the plush toy. Light rays from the lightbulb pass through the translucent globe and the translucent head and cause the face of the plush toy to glow until the child releases the pressure which he or she is applying on the front of the exterior cover of the plush toy.

These and many other features and objects of the present invention will be apparent from the following Brief Description of the Drawings, Detailed Description of the Preferred Embodiment and Claims, and the accompanying Drawings.

DETAILED DESCRIPTION OF THE PREFERRED EMBODIMENT

The preferred embodiment of the electrically lighted plush toy of the present invention is illustrated in FIGS. 1–6.

Figure 1:
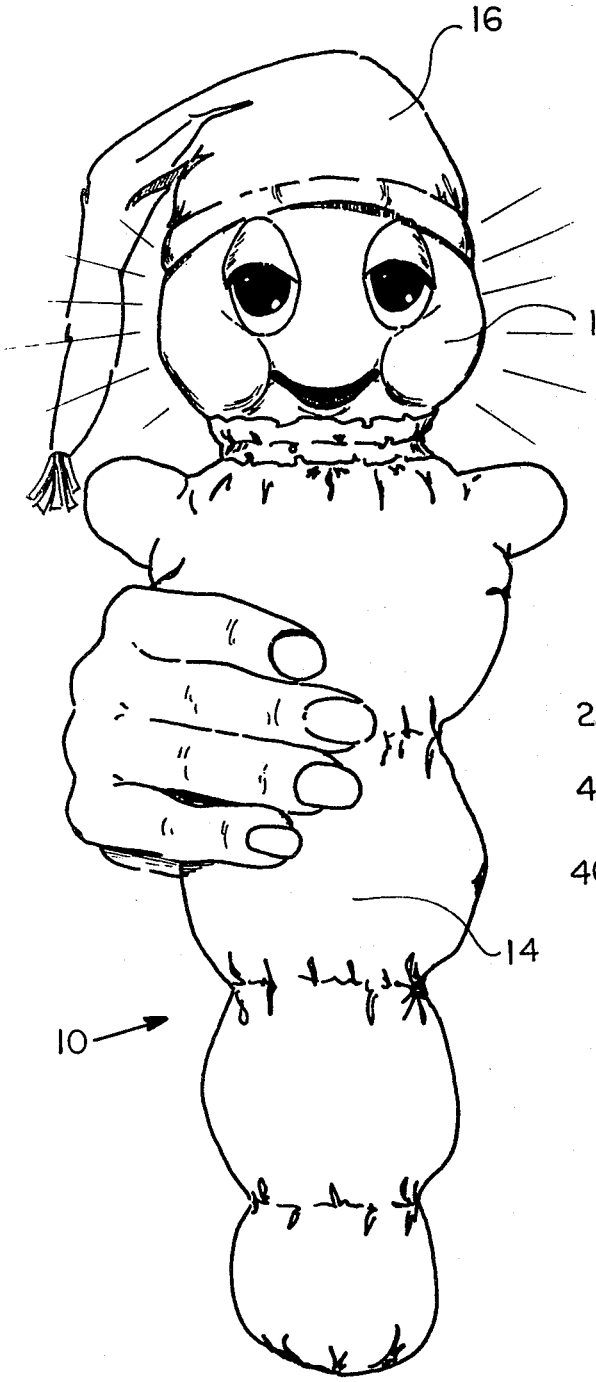
FIG. 1 is a front elevational view of one embodiment of the electrically lighted plush toy of the present invention illustrated with its face glowing.
Figure 2:
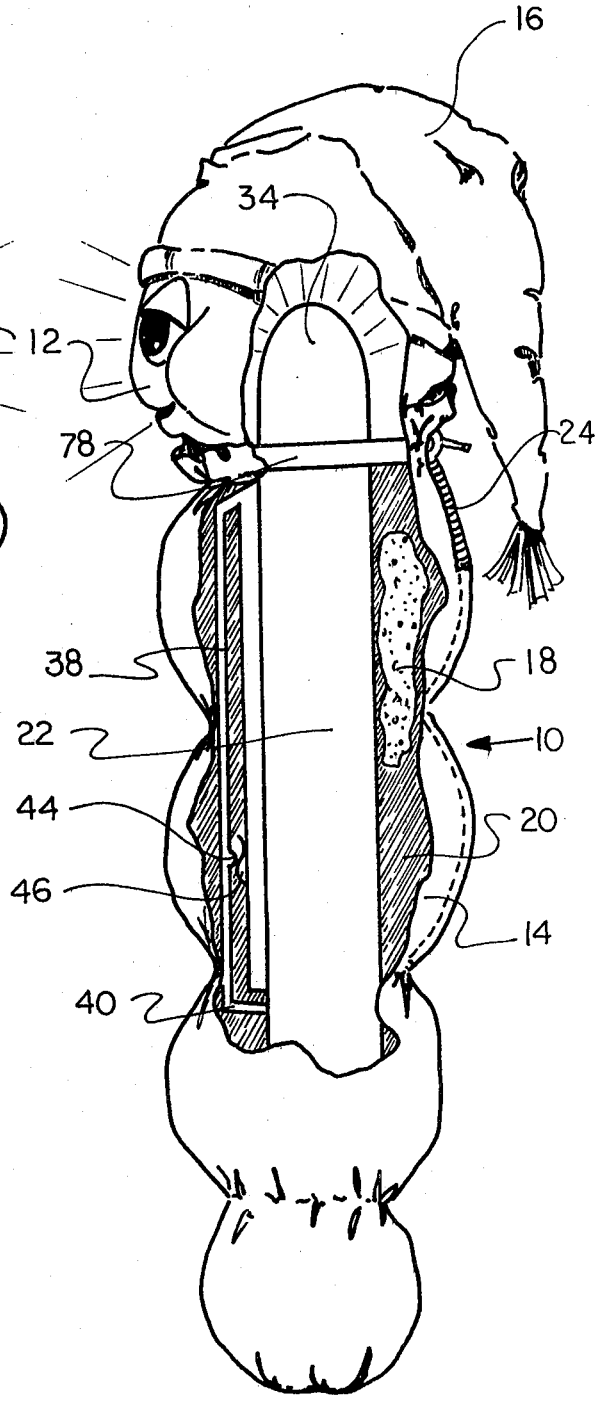
FIG. 2 is a side elevational view, in partial section, of the electrically lighted plush toy shown in FIG. 1 illustrating a removeable two part battery and lightbulb housing coaxially positioned in its interior and a retaining ring for said housing.

Referring to FIGS. 1 and 2, the electrically lighted plush toy which is illustrated is designated generally by the reference numeral 10. The plush toy includes a hollow, translucent head 12 and a plush exterior cover 14 in the approximate configuration of the skin covering the body of a segmented worm. Preferably, a plush cap 16 is fixedly attached to the upper portion of the head 12. Suitable materials and methods for manufacture of the head 12, cover 14 and cap 16 are well known in the prior art. For example, the head 12 can be molded from a semi-rigid vinyl or other elastomer. And, the cover 14 and cap 16 can be fabricated by cutting and sewing plush or other similar fabric.

Referring to FIG. 2, the plush exterior cover 14 encloses a resilient mass 18 in the approximate configuration of the body of a segmented worm. The resilient mass 18 is fabricated from a soft fibrous material which is stuffed between the plush exterior cover 14 and a sewn in fabric liner 20. While the plush exterior cover 14 could be removeably attached to the neck portion of the head 12, it is preferable to fixedly attach the cover 14 to the head 12 and provide an opening in the rear of the cover 14 for access to the interior space circumscribed by the cover 14, resilient mass 18 and liner 20 for installation and removal of an essentially cylindrical, translucent battery and lightbulb housing 22. Preferably, a conventional zipper 24 is sewn in the opening in the cover 14.

Figure 3:
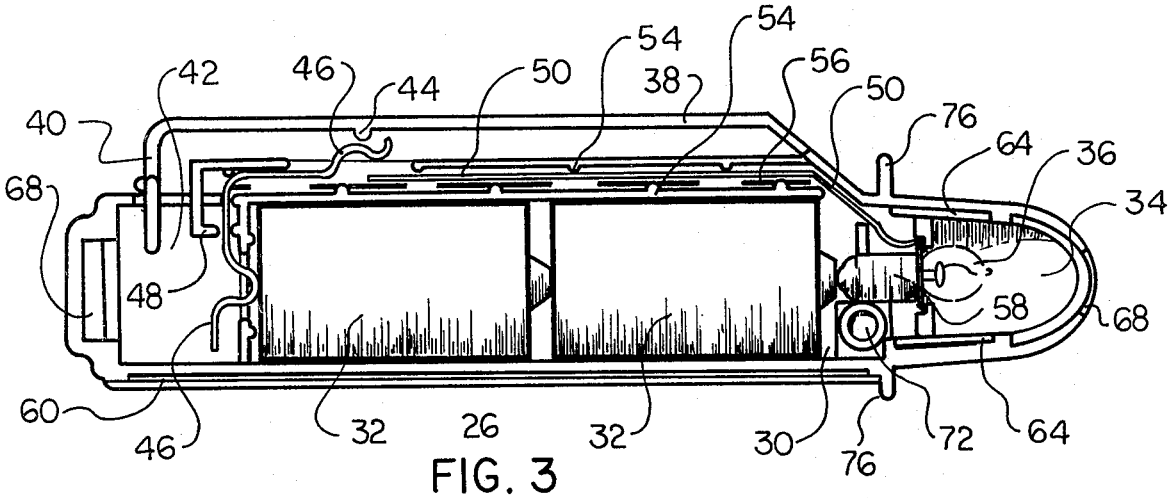
FIG. 3 is an elevational view of the right hand element of the two part battery and lightbulb housing shown in FIG. 2 illustrating a pair of batteries, a lightbulb and a pair of electrical conductors operatively positioned in its interior.
Figure 4:
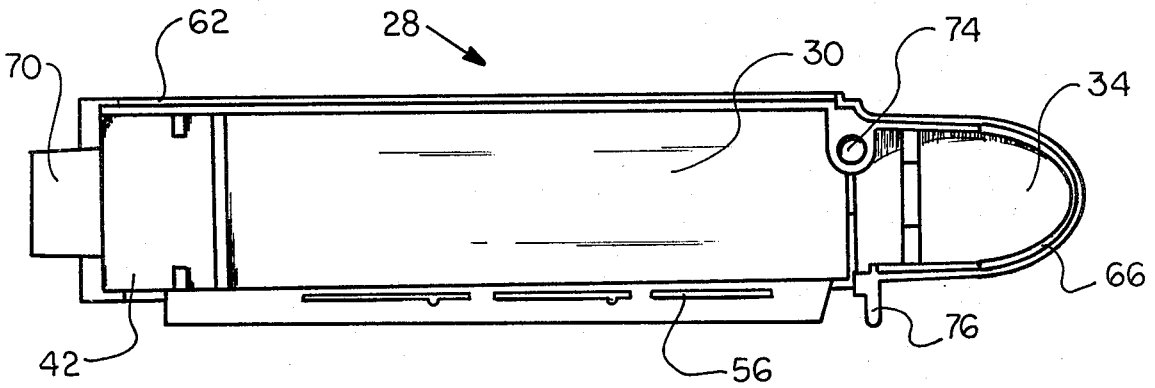
FIG. 4 is an elevational view of the left hand element of the two part battery and light bulb housing shown in FIG. 2 illustrating its interior configuration.

Referring to FIGS. 3 and 4, the battery and light bulb housing 22 which is illustrated in FIG. 2 coaxially positioned in the interior space circumscribed by the cover 14, resilient mass 18 and liner 20 comprises a right hand housing element 26 and a left hand housing element 28. For safety reasons, the housing elements 26 and 28 are molded from a dense polystyrene or other suitable plastic material. As illustrated in FIG. 3, the housing 22 has a integrally molded battery compartment 30 which houses a pair of conventional batteries 32 and an integrally molded globe 34 which houses a conventional lightbulb 36. The batteries 32 and lightbulb 36 are positioned end to end to form a portion of an electrical circuit for lighting the lightbulb 36.

Referring specifically to FIG. 3, an operating lever 38 is molded as an integral component of the right hand housing element 26. When the housing elements 26 and 28 are assembled to form the housing 22, the free end 40 of the operating lever 38 is moveably positioned in an opening 42 near the lower end of the housing 22. The operating lever 38 has a projection 44 which engages a first electrical conductor 46. Both the operating lever 38 and the electrical conductor 46 are configured essentially as a leaf spring. The electrical conductor 46, preferably a copper strip, is positioned in the interior of the battery compartment 30 by a plurality of retaining fingers 48 which are molded as integral components of the right hand housing element 26. One end of the first electrical conductor 46 engages the negative end of the rear battery 32 and the other end thereof is positioned above one end of a second electrical conductor 50. Both said end of the first electrical conductor 46 and said end of the second electrical conductor 50 are positioned in an opening 52 in the housing 22.

The second electrical conductor 50, like the first electrical conductor 46, is preferably a copper strip. However, while the retaining fingers 48 permit the first electrical conductor 46 to be depressed in the manner of a leaf spring to contact the second electrical conductor 50, a plurality of retaining fingers 54 and parallel supports 56 maintain the second electrical conductor 50 in an essentially stationary position at all times. The retaining fingers 54, like the retaining fingers 48, are molded as integral components of the right hand housing element 26. However, the parallel supports 56 are comprised of essentially identical right hand and left hand portions molded as integral components of the right hand housing element 26 and the left hand housing element 28, respectively. The end of the electrical conductor 50 opposite to its end positioned in the opening 52 of the housing 22 engages the conducting base 58 of the lightbulb 36 in the globe 34.

To facilitate assembly and disassembly of the housing 22 in a manner which is relatively easy for adults and extremely difficult for young children, the right hand housing element 26 has an intergrally molded, longitudinal groove 60 for receipt of an intergrally molded, longitudinal tongue 62 on the left hand housing element 28 when the housing 22 is assembled. Additionally, the right hand housing element 26 has a pair of projections which project into the interior of the left hand housing element 28 when the housing 22 is assembled. Similarly, the left hand housing element 28 has a projection 66 which projects into the interior of the right hand housing element 26 when the housing 22 is assembled. The right hand housing element 26 has an essentially rectangular eyelet 68 intergrally molded on its end opposite to the globe 34 for receipt of an essentially rectangular hook 70 intergrally molded on the end of the left hand housing element 28 opposite to the globe 34. The right hand housing element 26 has a threaded hole 72 near the globe 34 for alignment with a recessed, unthreaded hole 74 through the left hand housing element 28 near the globe 34. These holes 72 and 74 facilitate removeable attachment of the housing elements 26 and 28 with a small Phillips screw (not illustrated) during assembly of the housing 22. Finally, the right hand housing element 26 has a notch 68 or other similar indent for insertion of the head of a small flat head screwdriver or a coin or other similar implement to pry apart the tightly fitting housing elements 26 and 28 if necessary during disassembly of the housing 22.

Figure 6:
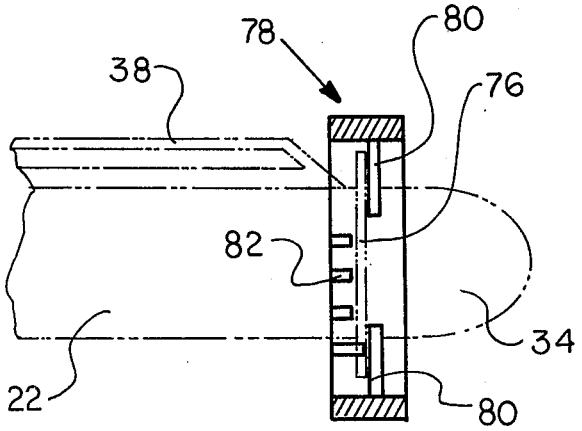
FIG. 6 is a sectional view of the retaining ring shown in FIGS. 2 and 5 taken along line 6—6 in FIG. 5 with the upper portion of the battery and light bulb housing shown in FIGS. 2, 3 and 4 illustrated in phantom.
Figure 5:
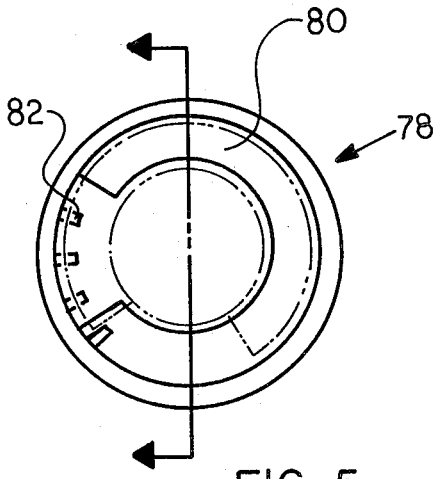
FIG. 5 is a top plan view of the retaining ring shown in FIG. 2 with the partial flange on the battery and light bulb housing shown in FIGS. 2, 3 and 4 illustrated in phantom.

To facilitate coaxial positioning and retaining of the battery and light bulb housing 22 in the interior space circumscribed by the cover 14, resilient mass 18 and liner 20 with its globe 34 positioned in the interior of the hollow, translucent head 12, the housing 22 is provided with a partial circumferential flange 76. Segments of the flange 76 are molded as integral components of the housing elements 26 and 28. Referring to FIG. 2, a retaining ring 78 is fixedly attached in the interior of the neck portion of the head 12 by force fitting or glueing. The retaining ring 78, like the housing elements 26 and 28, is molded from a dense polystyrene or other suitable plastic material. Referring to FIGS. 5 and 6, the retaining ring 78 has a partial interior flange 80 and a plurality of retaining fingers 82 parallel thereto molded as integral components thereof. When it is desired to coaxially position and retain the battery and the lightbulb housing 22 in the above described interior space, the globe 34 of the housing 22 is inserted through the retaining ring 78 with the gap in the circumferential flange 76 on the housing 22 aligned with the retaining a fingers 82 and the entire housing 22 is turned counterclockwise to lock the flange 76 in place in the space between the flange 80 and retaining fingers 82. This process is reversed when it is desired to remove the battery and lightbulb housing 22 from the above described interior space.

Having described the structure of the plush toy 10, its operation will now be described. Referring to FIGS. 1 and 2, the child grasps the plush toy 10 with the thumb and fingers of one of his or her hands and squeezes the front of the plush exterior cover 14 firmly to compress the cover 14, resilient mass 18, fabric liner 20 and operating lever 38. The projection 44 on the operating lever 38 depresses the first electrical conductor 46 until it contacts the second electrical conductor 50. When the first electrical conductor 46 contacts the second electrical conductor 50, the electrical circuit which consists of the conductors 46 and 50, the batteries 32 in the battery compartment 30 and the lightbulb 36 in the globe 34 is completed. The lightbulb 36 is lighted and remains lighted until the child releases his or her pressure on the front of the cover 14 of the plush toy 10, and, thereby, allows the operating lever 38 and first electrical conductor 46 to return to their normal positions and open the electrical circuit. For so long as the circuit is closed and the lightbulb 36 remains lighted, light rays pass through the translucent globe 34 and head 12 and cause the face of the plush toy 10 to glow.

While the present invention has been described in connection with its preferred embodiment, it should be understood that there may be other embodiments which fall within the scope and spirit of the invention as defined by the claims.

We claim:

1. An electrically lighted plush toy, comprising:

a semi-rigid vinyl, hollow, translucent head;

a plush exterior cover attached to said head;

a resilient mass enclosed by said cover;

an essentially cylindrical, molded plastic, translucent battery and lightbulb housing having an intergrally molded battery compartment, an integrally molded globe for enclosing a lightbulb, an integrally molded operating lever positioned on its exterior, a first electrical conductor positioned in its interior, and a second electrical conductor positioned in its interior, said first electrical conductor and said second electrical conductor being adapted to complete an electrical circuit including a battery in said battery compartment and a lightbulb in said globe when said operating lever is depressed; and a molded plastic retaining ring attached in the interior of the neck portion of said head, said retaining ring being adapted to coaxially position and retain said housing in the interior space circumscribed by said cover and said resilient mass.

2. An electrically lighted plush toy as recited in claim 1, wherein said housing comprises a right hand housing element which circumscribes one-half of said battery compartment and one-half of said globe and a left hand housing element which circumscribes the other half of said battery compartment and the other half of said globe, said operating lever being molded as an integral component of one of said housing elements.

3. An electrically lighted plush toy as recited in claim 2, wherein said first electrical conductor is positioned in the interior of said battery compartment of said housing such that one of its ends engages the negative end of said battery and the other of its ends is moveably positioned over one of the ends of said second electrical conductor by a plurality of retaining fingers which are molded as integral components of one of said housing elements, which comprise said housing, said second electrical conductor is positioned in the interior of said battery compartment of said housing such that one of its ends is positioned under said moveably positioned end of said first electrical conductor and the other of its ends engages the conducting base of said lightbulb by a plurality of retaining fingers which are molded as integral components of one of said housing elements and a plurality of parallel supports comprising right hand and left hand portions molded as integral components of said right hand housing element and said left hand housing element, respectively, and said operating lever has a projection which engages said moveably positioned end of said first electrical conductor when said operating lever is depressed and thereby depresses said moveably positioned end of said first electrical conductor until it contacts said end of said second electrical conductor positioned under said moveably positioned end of said first electrical conductor, both said moveably positioned end of said first electrical conductor and said end of said second electrical conductor positioned under said moveably positioned end of said first electrical conductor being positioned in an opening in said housing.

4. An electrically lighted plush toy as recited in claim 3, wherein said first electrical conductor is a copper strip and said second electrical conductor is a copper strip.

5. An electrically lighted plush toy as recited in claim 2, wherein one of said housing elements has a longitudinal groove and the other of said housing elements has a corresponding longitudinal tongue, each of said housing elements has a projection which projects into the interior of the other of said housing elements, one of said housing elements has an eyelet on its end opposite to said globe and the other of said housing elements has a corresponding hook on its end opposite to said globe, and one of said housing elements has a threaded hole near said globe and the other of said housing elements has a corresponding recessed, unthreaded hole near said globe, said holes being aligned for attachment of said housing elements with a screw.

6. An electrically lighted plush toy as recited in claim 1, wherein said cover has a sewn in fabric liner and said resilient mass is a resilient mass of soft fibrous material stuffed between said cover and said fabric liner.

7. An electrically lighted plush toy as recited in claim 6, wherein said cover, said resilient mass and said fabric liner have an opening there through for access to the interior space circumscribed by said cover, said resilient mass and said fabric liner for installation and removal of said housing coaxially positioned therein.

8. An electrically lighted plush toy as recited in claim 7, further comprising a zipper sewn in said opening.

9. An electrically lighted plush toy as recited in claim 1, wherein said housing has an integrally molded, partial circumferential flange between said battery compartment and said globe and said retaining ring has an integrally molded, partial interior flange and a plurality of integrally molded interior retaining fingers, said partial circumferential flange being positionable between said partial interior flange and said retaining fingers to interlock said housing and said retaining ring.

* * * * *